US009220941B2

(12) United States Patent
Barry

(10) Patent No.: US 9,220,941 B2
(45) Date of Patent: Dec. 29, 2015

(54) LIMB AND LIMB EXTREMITY EXERCISE DEVICE

(76) Inventor: James Anthony Barry, Sheffield (GB)

( * ) Notice: Subject to any disclaimer, the term of this patent is extended or adjusted under 35 U.S.C. 154(b) by 1474 days.

(21) Appl. No.: 12/921,220

(22) PCT Filed: Mar. 7, 2008

(86) PCT No.: PCT/GB2008/000789

§ 371 (c)(1),
(2), (4) Date: Feb. 21, 2012

(87) PCT Pub. No.: WO2008/107687

PCT Pub. Date: Sep. 12, 2008

(65) Prior Publication Data

US 2012/0190515 A1 Jul. 26, 2012

(30) Foreign Application Priority Data

Mar. 7, 2007 (GB) ..... 0704355.7

(51) Int. Cl.

| | |
|---|---|
| ***A63B 71/00*** | (2006.01) |
| ***A63B 23/10*** | (2006.01) |
| ***A63B 21/00*** | (2006.01) |
| ***A63B 21/055*** | (2006.01) |
| ***A63B 23/16*** | (2006.01) |
| *A63B 21/04* | (2006.01) |
| *A63B 21/05* | (2006.01) |
| *A63B 21/062* | (2006.01) |
| *A63B 71/06* | (2006.01) |

(52) U.S. Cl.

CPC ..... *A63B 23/10* (2013.01); *A63B 21/00181* (2013.01); *A63B 21/055* (2013.01); *A63B 21/1434* (2013.01); *A63B 21/154* (2013.01); *A63B 23/16* (2013.01); *A63B 21/0442* (2013.01); *A63B 21/05* (2013.01); *A63B 21/062* (2013.01); *A63B 71/06* (2013.01); *A63B 2071/0063* (2013.01); *A63B 2225/09* (2013.01)

(58) Field of Classification Search

CPC ..... A63B 21/00181; A63B 21/055; A63B 21/154; A63B 23/10; A63B 21/16; A63B 2225/09; A63B 2225/093; A63B 23/16

USPC ..... 482/44–50, 70, 79, 80, 121–123, 128, 482/132, 135, 137, 139, 907, 908; 601/23, 601/27–32, 33–35, 40; 434/247, 258, 260

See application file for complete search history.

(56) References Cited

U.S. PATENT DOCUMENTS

| | | | | | |
|---|---|---|---|---|---|
| 1,509,793 | A | * | 9/1924 | Thompson | 482/79 |
| 1,911,390 | A | * | 5/1933 | Pullman | 482/79 |
| 2,250,493 | A | * | 7/1941 | Milne | 482/79 |
| 2,476,518 | A | * | 7/1949 | Underwood | 482/48 |
| 3,088,458 | A | * | 5/1963 | Stewart | 601/122 |
| 3,606,316 | A | * | 9/1971 | Krewer | 482/47 |
| 3,809,393 | A | * | 5/1974 | Jones | 482/132 |

(Continued)

*Primary Examiner* — Loan H Thanh
*Assistant Examiner* — Gregory Winter
(74) *Attorney, Agent, or Firm* — Franks & Co. EU Patent & Trademark Attorneys; Howard Lock

(57) ABSTRACT

An exercise device is suitable for progressively strengthening the intrinsic muscle groups of a limb extremity and the associated limbs of a user. The device has a base unit and a gripping surface. The gripping surface can be gripped by at least one of the digits of the limb extremity of the user. The exercise device further includes a system for applying resistance. The gripping surface is configured to adapt to fit the shape of the digits of the limb extremity of the user.

11 Claims, 13 Drawing Sheets

(56) References Cited

U.S. PATENT DOCUMENTS

| | | | | | |
|---|---|---|---|---|---|
| 3,871,646 | A | * | 3/1975 | Slack | 482/48 |
| 4,350,335 | A | * | 9/1982 | Pasbrig | 482/47 |
| 4,368,728 | A | * | 1/1983 | Pasbrig | 601/40 |
| 4,461,472 | A | * | 7/1984 | Martinez | 482/79 |
| 4,836,531 | A | * | 6/1989 | Niks | 482/44 |
| 5,078,387 | A | * | 1/1992 | Faust et al. | 482/44 |
| 5,303,696 | A | * | 4/1994 | Boice | 601/33 |
| 5,451,191 | A | * | 9/1995 | Beenken | 482/47 |
| 6,179,750 | B1 | * | 1/2001 | Lonergan | 482/47 |
| 2007/0037672 | A1 | * | 2/2007 | Nakanishi | 482/79 |

* cited by examiner

701

701

LIMB AND LIMB EXTREMITY EXERCISE DEVICE

FIELD OF THE INVENTION

The invention relates to an exercise device suitable for progressively strengthening the intrinsic muscle groups of a limb extremity and the associated limb of a user, the device comprising a base unit, a gripping surface configured to be gripped by at least one of the digits of the limb extremity of said user and a resistence means.

BACKGROUND TO THE INVENTION

At present, there are no adequate resistant training facilities to train and progressively strengthen the intrinsic muscle groups of the foot and/or hand and the associated lower limbs through resistance training. In particular, it is important to develop and strengthen the muscles in the foot and the lower leg from an early age as developing these muscles will have a positive effect on a person's health and performance in many sports. However, from an early age, a lack of gripping, climbing and a lack of bare foot activities worsens the condition of the muscles groups, preventing the muscles from working efficiently and therefore weakening the feet. This problem worsens as a person grows older and can lead to many health problems through the lower joints up to the neck and back and can also have a detrimental effect on a person's balance. Therefore, it is advantageous to have a resistance training facility which progressively exercises the required muscle groups of the foot and lower leg from an early age to prevent such health problems.

Furthermore, such a resistance training facility is required for rehabilitation purposes to treat many injuries of the intrinsic muscle groups of the foot and lower leg, including metatarsal injuries, therefore enabling a speedy recovery from such injuries and keeping the muscle groups active and healthy.

It is also recognised that such a resistance training facility could potentially be used by an athlete wishing to improve their sport performance by increasing their balance, speed and jumping ability.

A previous method of treating injuries of the foot and/or lower leg involves the use of a towel and a dead weight. The injured person sits on a bench with their foot directly below their knee and their toes placed on one end of the towel. The dead weight is placed at the second end of the towel and the person grips the towel with their toes and drags the dead weight towards them.

A further method of treating the injuries of the foot and/or lower leg involves the injured person picking up marbles with the toes of their injured foot by gripping the marbles between the joints of the toes.

Although such methods are adequate for rebuilding the strength in the foot and lower leg, they cannot be used to progressively strengthen the muscle groups in the foot and lower leg therefore, strengthening the muscle groups against further injuries. Furthermore, such exercises do not allow for eccentric training: training in which the muscles are contracting whilst lengthening, as the toes are gradually returned to their starting position under resistance.

U.S. Pat. No. 4,461,472 (Martinez) discloses an exercise device suitable for exercising the metatarsal arch after a metatarsal injury has occurred. The exercise device comprises a housing and a sliding device which is guided by a guiding rod and is spring loaded against the housing, producing resistance against the flexing of the metatarsal arch.

The problems with exercise device of U.S. Pat. No. 4,461,472 is that the gripping bar is straight and so the exercise device can only effectively train the big toe and possibly the adjacent second toe. None of the other toes will fit over the gripping bar due to the natural curvature of the toe joints of the user. Therefore, a number of the important muscle groups in the foot and lower leg are not trained by the device. Furthermore, as the sliding device is moved relative to resistance produced by a spring attached to the guiding rod, it is not possible to progressively train the foot and lower leg as is it not possible to increase or decrease the spring resistance and hence the resistance against the flexing of the metatarsal arch. Further, a build up of friction may occur as the sliding base is pushed backwards and forwards against the spring resistance which is detrimental to the operation of the device.

An alternative device is disclosed in U.S. Pat. No. 4,577,861 (Bangerter) which describes an exercise machine capable of progressively strengthening the muscles of the fingers and/or toes and associated limbs. This machine comprises a hinged platform attached to a support member upon which the user of the machine places their hand or foot such that their fingers or toes are disposed on the platform. The hinged platform is linked up to a weight stack carrying a load which can be increased or decreased to progressively train the muscles. The platform is pressed down by the fingers or toes against the resistance of the weight stack, thereby flexing the muscles in the hand or foot and the associated limb.

The problem with the exercise machine disclosed in U.S. Pat. No. 4,577,861 is that the joint between the hinged platform and support member is straight, whereas the proximal joints of the fingers or toes of the user have a curved arrangement. Therefore, any proximal joints which do not line up with the joint of the machine will not contribute to the exercise and so the associated muscles will not be trained.

Furthermore, when all of the digits of the hand or foot are placed on the hinged platform, many of the proximal joints be located in front of the joint and hence pivot of the machine. Therefore, the proximal joints will not be aligned with the joint of the machine, causing a build up of friction as the digits scrap backwards on the hinged platform, when the platform is pressed down, and scrap forwards as the platform returns to its starting position. This also prevents a number of the muscle groups of the foot or hand and the associated limbs from being effectively trained by this machine.

The inventor has sought to provide an exercise device which progressively trains all of the intrinsic muscle groups of the foot and/or hand and associated limbs, which may be employed to prevent health problems, overcome sport injuries and improve performance in sport

SUMMARY OF THE INVENTION

An object of the present invention is to provide a exercise device which progressively trains all of the intrinsic muscles of a limb extremity and the associated limbs.

The invention achieves this objective by provision of an exercise device suitable for progressively strengthening the intrinsic muscle groups of a limb extremity and the associated limbs of a user, said device comprising:

a base unit;

a gripping surface configured to be gripped by at least one of the digits of said limb extremity of said user; and a resistance means;

wherein said gripping surface is configured to adapt to fit the shape of said at least one of the digits of said limb extremity of said user.

By limb extremity it is meant the foot or hand of the user. The associated limb will be the leg or arm to which the foot or hand is attached.

The gripping surface of the exercise device of the present invention fits to the shape of at least one of the digits of the limb extremity of the user by adapting to match the size and distribution of the at least one digit. It is known that the distribution of the digits of a limb extremity is curved and that the curvature of the distribution of digits varies in one person to the next. Therefore, the exercise device of the present invention provides a means for exercising all of the digits of the user regardless of the size and distribution of their digits, to ensure that all of the intrinsic muscle groups of the limb extremity and associated limb are worked and progressively trained by the exercise device.

The adaptable gripping surface allows for the contribution of all of the toes or fingers to the exercise, therefore utilising all of the muscle groups of the limb extremity and associated limb. For example, the important intrinsic muscle groups of the foot and lower leg which may be worked by the exercise device of the present invention includes:

The Flexor Hallucis Longus which runs down the calf of the lower leg to the big toe via the inside of the ankle;

The Flexor Digitoram Longus which runs down the back of the calf to all toes via the inside of the ankle;

The Flexor Digitoram Brevis which runs from the heel of the foot to the toes; and The Flexor Hallucis Brevis which runs from the heel of the foot to the big toe.

The exercise device further allows the user to work the transverse arch and lateral arch of the outside of the foot as well as the arch on the instep of the foot.

The adaptable gripping surface design allows for the personalisation of the shape of the gripping surface such that all users can gain maximum results when using the exercise device of the present invention.

Preferably, the resistance means is capable of varying the resistance force provided to said exercise device.

The exercise device of the present invention will enable the user to strengthen the intrinsic muscles of the limb extremity and associated limb progressively by enabling the user to vary the resistance force acting on the device as the fingers or toes become stronger. Variation of the resistance means also enables the resistance to be adapted to the individual strength of the user, therefore enabling the same exercise device to be used by a person who has recently suffered a muscle injury or a person wishing to improve their performance in sports.

In a preferred embodiment of the present invention, the gripping surface comprises a plurality of protrusions extending from said gripping surface; and movement of each of said plurality of protrusions is independent of the movement of each adjacent protrusion.

Alternatively, the gripping surface may comprise a plurality of recessed sections extending into said gripping surface; and movement of each of said plurality of recessed sections is independent of the movement of each adjacent recessed sections.

In a further alternative embodiment of the present invention, the gripping surface is in the form of a detachable bar, said detachable bar being interchangeable with another detachable bar to adapt said gripping surface to fit the shape of said at least one of the digits of said limb extremity of said user.

Preferably, the exercise device further comprises a moveable portion configured to act against said resistance means.

In a first preferred embodiment of the invention, the moveable portion is located within a recess of said base unit; said moveable portion being configured to move longitudinally within said recess.

In this embodiment, the moveable portion comprises a platform and at least one roller element;

said at least one roller element being located within said recess of said base unit; and said platform being disposed upon said at least one roller element.

Preferably, the gripping surface is disposed upon the upper surface of said platform and the platform is connected to said resistance means.

Roller elements are employed in this first preferred embodiment of the invention as they will reduce the build up of friction as the platform of the removeable portion moves forward and backwards by application of force from the digits of the user, against the resistance means. It further allows smooth movement of the platform from a relaxed to a tensed position, therefore enabling the exercise device to be used effectively for extended periods of time.

In a second preferred embodiment of the present invention, the moveable portion extends from a first end of said base unit.

In this embodiment, the moveable portion comprises a platform and an inclined frame;

said platform being slidably mounted upon said inclined frame.

Preferably, the inclined frame is pivotably connected at said first end of said base unit to allow downward and upward movement of said moveable portion.

Furthermore it is preferable that the gripping surface is disposed upon said platform and the inclined frame is connected to said resistance means.

The provision of a platform which is slideably mounted on the inclined frame of the moveable portion enables the digits of the user the freedom of movement as the inclined platform moves downwards and upwards against the resistance means. This is advantageous as if the digits were held stationary, there would be a build up of friction between the digits and the platform. Therefore, the arrangement of the platform and inclined frame of the moveable portion of the second preferred embodiment enhances the useability of the exercise device of the present invention.

Preferably the exercise device further comprises an adjustable heel support means.

A heel support can be adjusted to secure variable foot sizes to the device ensuring correct technique and preventing injury. The provision of the heel support prevents the user of the device from performing "cheat movements" wherein the user of the device effects movement of the moveable portion against the resistance means by using their whole leg rather than the digits of their limb extremity as the exercise device requires. In this way, the user would not be working the required muscles of the limb extremity and associated limb, therefore rendering the exercise device ineffective. The heel support prevents occurrence of such "cheat movements".

The resistance means may comprise a pulley system configured to be attached to an external weight stack or alternatively, it may comprise a pulley system configured to be attached to an internal elastic resistance means, said internal elastic resistance means being disposed within said base unit.

The pulley system employed in either of the resistance means described above may be identical, therefore allowing the exercise device to be used with either an external weight stack or an internal elastic resistance means. Furthermore, when the pulley system is used with an external weight stack, the arrangement of the pulley system allows the exercise device to be fitted to any existing pulley weight stack in a gym.

In a specific embodiment of the present invention, the platform of said moveable portion comprises an inner shell and an outer shell;

said outer shell comprising a recessed portion in which said inner shell is disposed; and said inner shell being capable of lateral movement within said recessed portion of said outer shell.

Preferably the platform further comprises a resilient means configured to oppose the lateral movement of said inner shell within said recessed portion of said outer shell.

The provision of a platform comprising an inner shell and an outer shell, the inner shell being capable of lateral movement opposing resilient means, allows the exercise device of the present invention to directly work the abductors and adductors of the limb extremity. The working of such muscle groups effectively stabilises the limb extremity in the sideward direction. This is particularly important when the device is used to exercise the foot of a user as it heavily influences the functioning of the foot and stabilises movement and balance thereof.

In a preferred embodiment of the present invention, the moveable portion comprises a spotting means configured to allow the user of said exercise device to assist the movement of said moveable portion against said resistance means.

The provision of a spotting means in the exercise device of the present invention enables the user to assist the movement of the moveable base against the resistance means, therefore providing a number of different elements of training for the use of the device. In particular, the spotting means can enable the user of the exercise device to use a greater resistance force by enabling the limb extremity to reach a tensed position aided by the spotting means, slowly relieve the tension in the spotting means and then hold the limb extremity in the tense position. This teaches the muscle to hold tension more effectively.

Alternatively, when the spotting means has assisted the limb extremity to reach the tensed position against a greater resistance, the user may then release the tension slowly with the limb extremity.

Furthermore, as it has been identified that the limb extremities are not accustomed to such exercise, the spotting means will enable the limb extremity to reach a fully curled position which could not be reached by use of the muscles in the lower extremity alone.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Figure 1:
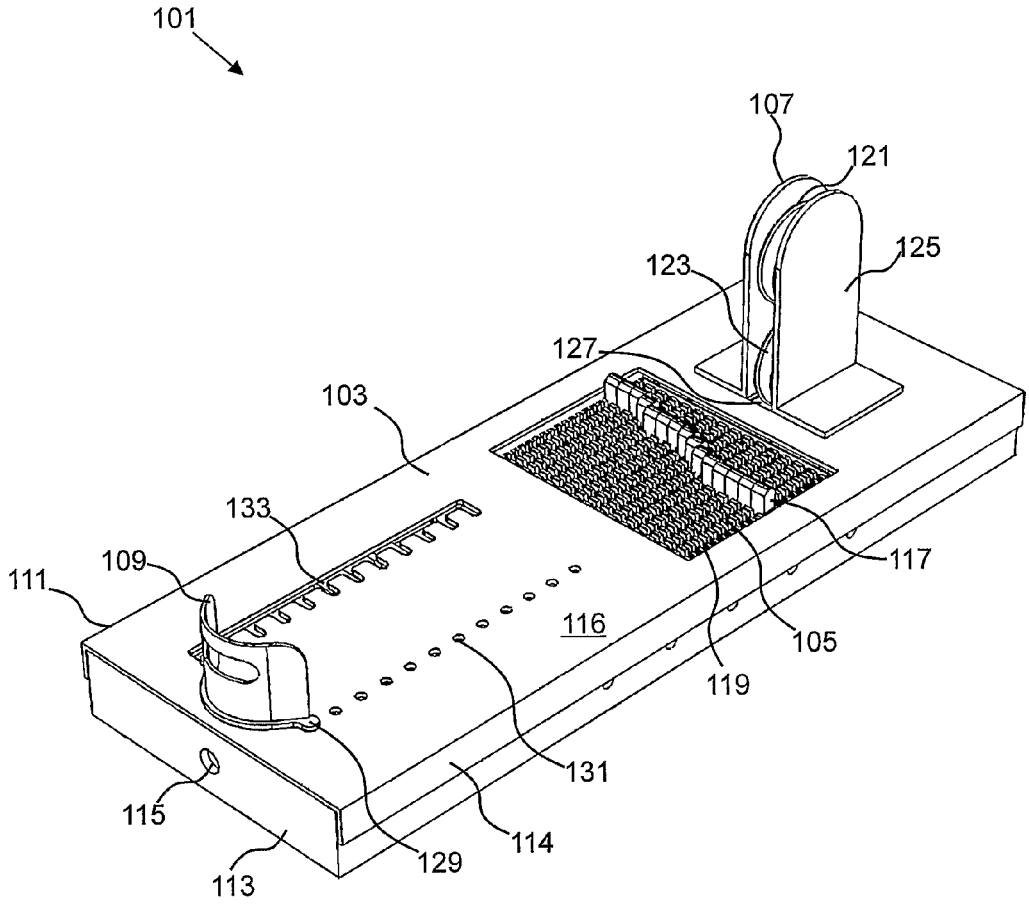
FIG. 1 shows a top perspective view of the exercise device in accordance with a first embodiment of the present invention.

With reference to FIG. 1 herein, there is shown an exercise device 101 in accordance with a first embodiment of the present invention. Exercise device 101 comprises a base unit 103, a gripping surface 105, a pulley system 107 and a heel support 109.

Base unit 103 is in the form of a rectangular box having an upper shell 111 and a lower shell 113. Lower shell 113 forms the base portion and four side walls of the rectangular box shape of the base unit 103. Lower shell 113 comprises an aperture 115 which is located on the rear lateral side wall thereof. Lower shell 113 also comprises a non-slip material such as rubber, which is attached to the underside of the lower shell 113 of the base unit 103 to prevent movement of the exercise device 101 when in use.

Upper shell 111 covers the uppermost edges of the lower shell 113, having side portions 114 which extend down a portion of the longitudinal side walls of the lower shell 113. The uppermost surface 116 of upper shell 111 comprises a cushioning means (not shown) to cover a portion of the surface which will be in contact with the foot of the user of the exercise device 101. Cushioning means may be formed of foam covered with leather or a resilient material such as rubber to provide comfort to the user during use of the exercise device 101.

Gripping surface 115 is disposed at the uppermost surface 116 of the upper shell 111 of the base unit 103. Gripping surface 105 comprises fifteen protrusions 117 extending upwards therefrom and fifteen corresponding tracks 119. Corresponding tracks 119 extend in the longitudinal direction over gripping surface 105 and have a plurality of engaging means which protrude slightly from the gripping surface 105. Protrusions 117 are moveable along the corresponding tracks 119 and are fixed in the required position by engagement with the engaging means of the corresponding tracks 119. Protrusions 117 may be repositioned by the user of the exercise device 101 so as to fit the size and distribution of their toes.

In an alternative embodiment of the present invention, protrusions 117 are replaced with a plurality of recessed sections which are moveable about corresponding tracks 119 to provide the adaptable gripping surface 105.

Pulley system 107 comprises an upper pulley 121 and a lower pulley 123 held in position by a stabilising structure 125. Pulley system 107 further comprises a cable (not shown) which passes over the lower pulley 123, then over the upper pulley 121 and is connected to a variable resistance device (not shown), for example an external weight stack or an internal elastic resistance.

Pulley system 107 is located on the uppermost surface 116 of the upper shell 111 of the base unit 103 with lower pulley 123 being positioned over a slot 127 in the uppermost surface 116. In this way, the cable (not shown) of the pulley system 107 is fed over the lower pulley 123 from the interior of the base unit 103, where it is connected to a moveable portion (not shown).

Heel support 109 has a curved shape in order to fit the curve of the heel of a user of the exercise device 101. Heel support 109 comprises two lugs 129 positioned at either side of heel support 109, extending downwards thereform. Heel support 109 is located on the uppermost surface 116 of the upper shell 111 of the base unit 103.

Uppermost surface 116 of the upper shell 111 of the base unit 103 comprises a series of holes 131 and a branched track 133 extending parallel to the series of holes 131 in a longitudinal direction along the uppermost surface 116. The series of holes 131 are aligned with the branches of the branched track 133. The series of holes 131 and branched track 133 are configured to receive the downwardly extending lugs 129 of the heel support 109 to secure the heel support 109 in position and provide a mechanism for adjusting the heel support 109 to fit any size foot of the user of the exercise device 101.

In use, the user unclips the right-hand lug 129 from the hole 131 in which it is located, moves the left-hand lug (not shown) out of the branch and along the track of the branched track 133 and re-positions the heel support 109 by first inserting the left-hand lug in the required branch of the branched track 133 and then inserting the right-hand lug 129 into the corresponding hole 131. In this way, the user can position the heel support 109 to fit the size of their foot, such that their toes fit over the protrusions 117 of the gripping surface 105.

Figure 2:
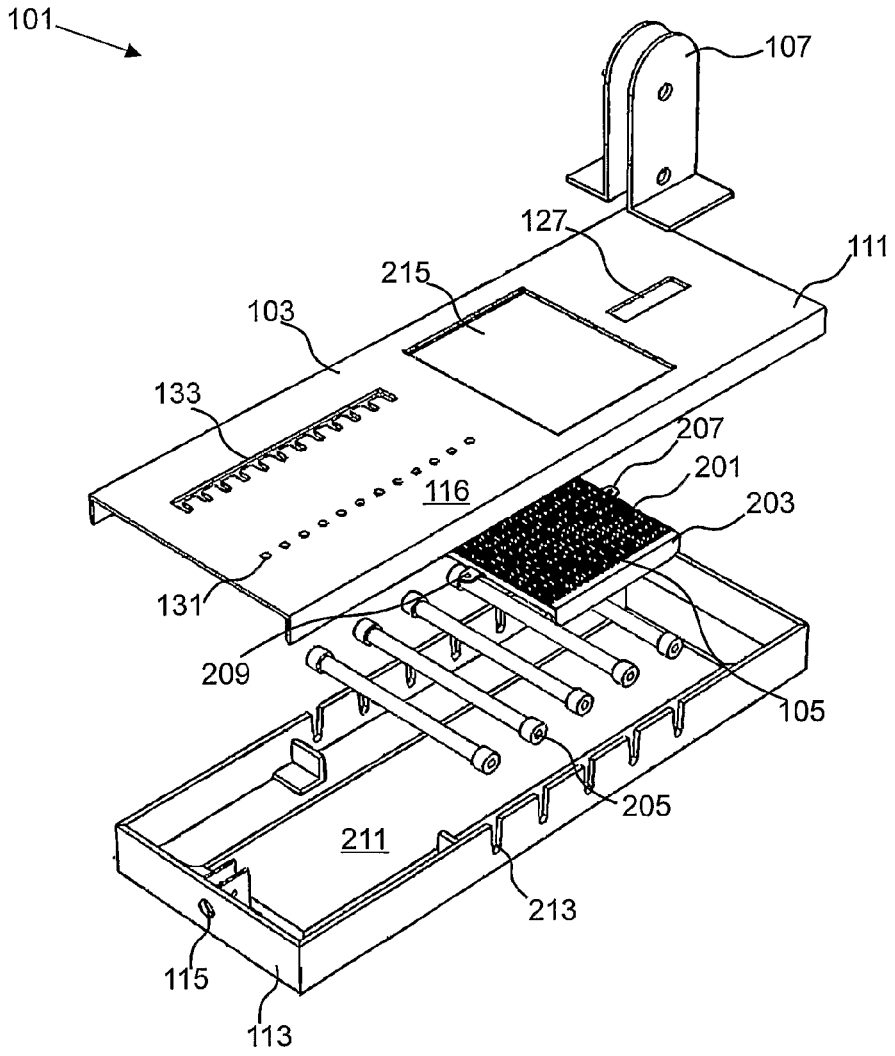
FIG. 2 shows the exploded top perspective view of the exercise device of FIG. 1.

With reference to FIG. 2 herein there is shown an exploded view of the exercise device 101 of FIG. 1 in which the heel support 109, the protrusions 117 of the gripping surface 105 and the pulleys 121 and 123 of the pulley system 107 have been removed. Accordingly, many of the features of FIG. 2 are identical to those of FIG. 1 and so will not be discussed in relation to FIG. 2 so as not to repeat the description.

Exercise device 101 further comprises a moveable portion 201 comprising a platform 203 and five roller elements 205. Moveable portion 201 is disposed with a recessed area 211 of the base unit 203.

Platform 203 is rectangular having the gripping surface 105 disposed on the uppermost surface thereof. Platform 203 comprises two attachment means 207 and 209 in the form of two eyelets, located centrally on the front and rear edge of the platform 203. Attachment means 207 is fitted with a cable (not shown) which feeds through slot 127 to the pulley system 107 which is attached to a resistance device such as an external weight stack or an internal elastic resistance. Attachment means 209 is fitted with a second cable (not shown) which runs out of the lower shell 113 of the base unit 103 via aperture 115. The second cable is attached to a handle which allows the user of the exercise device 101 to "spot" the movement of the moveable portion 201 against the resistance means. By "spot" it is meant that the user of the exercise device 101 can use the handle to which the second cable is attached to assist the movement of the platform 203 of the moveable portion 201 against the resistance means, therefore enabling the foot to move the platform 203 against a greater resistance force than would be possible by the strength of their foot alone.

Roller elements 205 of the moveable portion 201 are disposed within the recessed area 211 of the lower shell 113 of the base unit 103. Roller elements 205 are held in position within the recessed area 211 via a series of grooves 213, disposed on the longitudinal side walls of the lower shell 113. The grooves 213 on either side wall of the lower shell 113 are aligned such that when the roller elements 205 are in position within the recessed portion 211, they are parallel to one another and to the lateral side walls of the lower shell 113.

Roller elements 205 are cylindrical and are capable of rotation within the grooves 213 of the lower shell 113 of the base unit 103. Platform 201 is disposed upon the roller elements 205 such that the platform 203 rolls forwards and backwards on the roller elements 205 in use.

Upper shell 111 of the base unit 103 comprises a rectangular cut-away section 215. When the upper shell 111 of the base unit 103 is in position over the lower shell 113 (as in FIG. 1) and the exercise device 101 is not in use, the platform 203 of the moveable portion 201 is positioned in alignment with and beneath the cut-away section 215 of the upper shell 111. The protrusions (not shown) of the gripping surface 105 extend upwards through the cut-away portion 215, sufficiently high enough to allow the user of the exercise device 101 to successfully curl their toes around the protrusions. Accordingly, the rectangular cut-away portion 215 is of substantially similar dimensions to the platform 203 of the moveable portion 201.

Figure 3A:
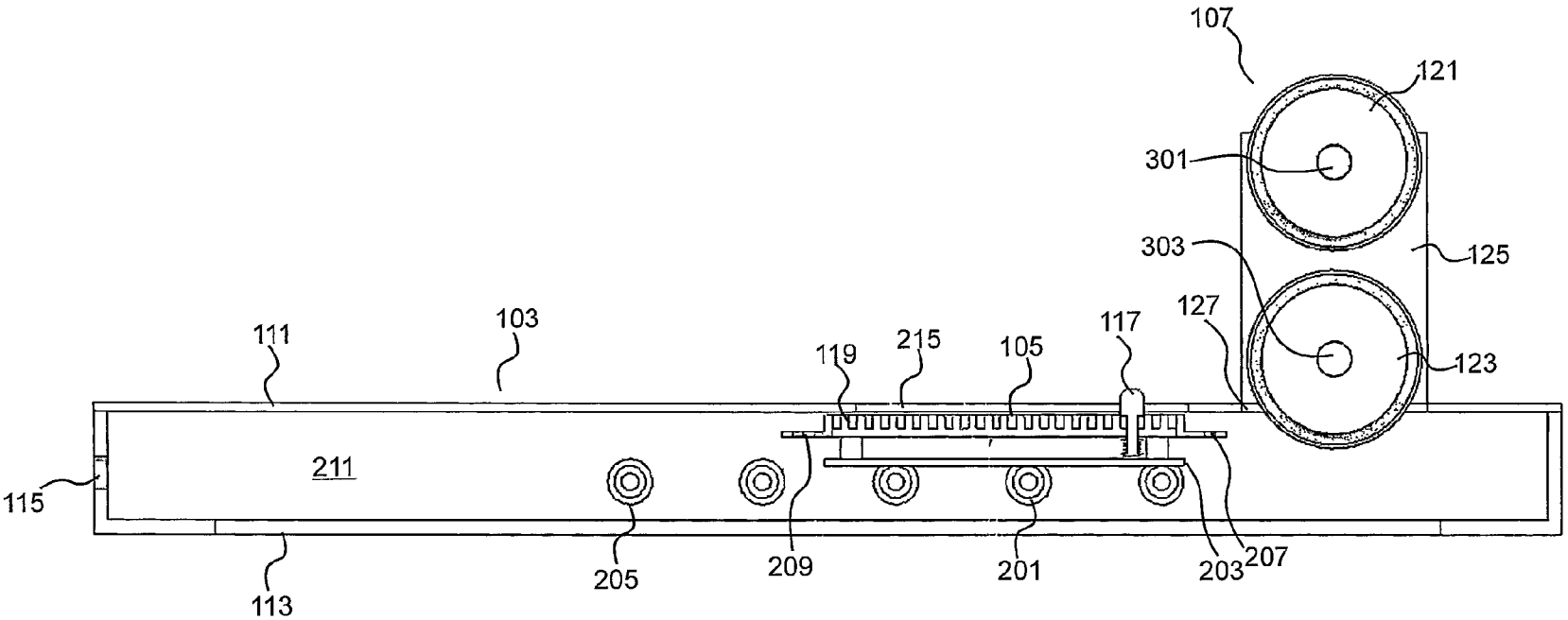
FIG. 3*a* shows a cross-sectional view of the exercise device of FIG. 1 in a relaxed position.
Figure 3B:
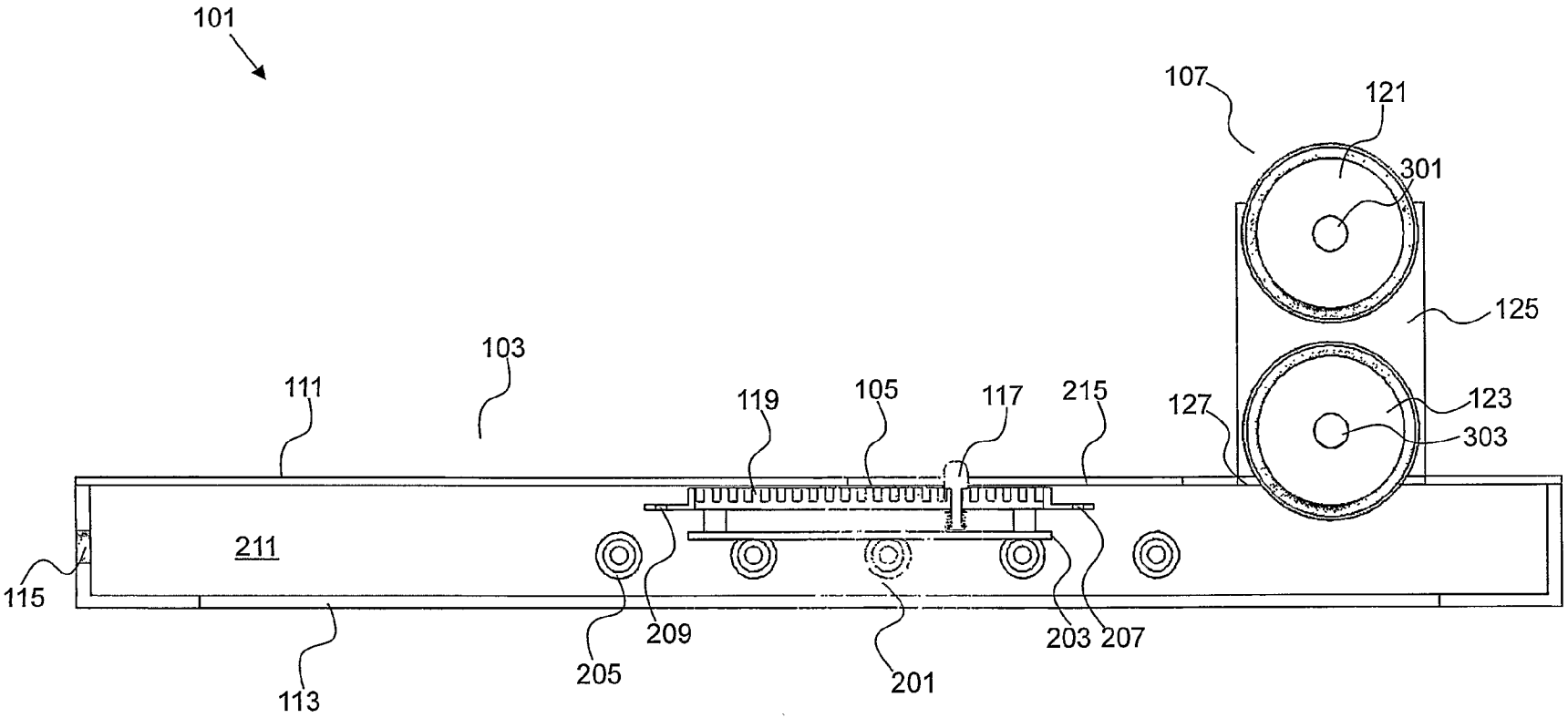
FIG. 3*b* shows a cross-sectional view of the exercise device of FIG. 1 in a tensed position.

FIGS. 3*a* and 3*b* shows the exercise device 101 of FIGS. 1 and 2 in a first relaxed position and a second tensed position respectively. The exercise device 101 of FIG. 1 is shown in cross-section with the heel support and the cable linking the moveable portion 201 to the pulley system 107 of the resistance means removed.

When the exercise device 101 of FIG. 1 is assembled, the roller elements 205 of the moveable portion 201 are disposed within the recessed area 211 of the lower shell 113 of the base unit 103 and are rotatable about a fixed position. Platform 203 is located upon the roller elements 205 beneath the rectangular cut-away section 215 of the upper shell 111 of the base unit 103, such that the protrusions 117 of the gripping surface 105 extend upwardly through the cut-away section 215.

A variable resistance device such as an external weight stack or an internal elastic resistance is connected to the platform 203 of the moveable portion 201 via pulley system 107. The cable (not shown) of the pulley system 107 is secured to the attachment means 207 of the platform 203. The cable then exits the recessed area 211 of the lower shell 113 of the base unit 103 via slot 127 and passes over lower pulley 123 and upper pulley 121 of the pulley system 107 such that the path of the cable forms an "S" shape. From the upper pulley 121, the cable is attached to the resistance device.

If the exercise device 101 is to be used with an external weight stack, once the cable has passed through pulley system 107, it may either be connected via a ring clip to an external resistance cable which is attached to the external weight stack, or connected directly to the external weight stack. The load of the external weight stack may be varied to vary the resistance force as required by the user of the exercise device.

If the exercise device 101 is to be used with an internal elastic resistance, the internal elastic resistance may comprise a plurality of elastic resistance cords. These elastic cords are fixed within a box housing which is extendable and retractable, allowing freedom of movement to the cords. The box housing is designed to be attached to and detached from the device 101. In use, the box housing is connected to the front portion of base unit 203 via pegs. The front surface of the box housing is connected to the platform 203 of the moveable portion 201 via pulley system 107 and the attachment means 207. When the platform 203 is subjected to a pulling force via the gripping surface 105, resulting in movement of the platform 203 towards the rear of the base unit 103, the box housing extends causing the elastic cords to stretch, thus supplying elastic resistance to the rear displacement. When the pulling force is removed the elastic cords retract and the platform 203 returns to its relaxed position. The elastic resistance cords may be tightened or loosened to vary the elastic resistance force.

A further cable is attached to the second attachment means 209 of the platform 203 of the moveable portion 201, which exits the recessed area 211 of the lower shell 113 via aperture 115. The second cable may be used to "spot" or assist the motion of the platform 203 against the resistance means.

In preparation for use of the exercise device, the user of the exercise device 101 adjusts the protrusions 117 of the gripping surface 105 by moving them along the corresponding tracks 119 so that the distribution of the protrusions 117 on the gripping surface 115 matches the shape of the toes and the curvature of the joints of the user of the exercise device 101. The heel support (not shown) which is disposed upon the uppermost surface 116 of the upper shell 111 of the base unit 103 may be adjusted to fit the foot size of the user, such that the toe joints of the user are located at the base of the protrusions 117 of the gripping surface 105 and their toes curled over the protrusions 117. In this way, the foot is supported by the heel support, ensuring that the user of the exercise device 101 uses the correct technique and also preventing any injuries from occuring. The user of the exercise device 101 then selects the type of resistance device and resistance force provided by the resistance device.

The user of the exercise device 101 may then position their foot on the device 101 such that the heel rests against the heel support and the toes curl over the protrusions 117 of the gripping surface 105, gripping the platform 203 of the moveable portion 201. In use, the user pulls the platform 203 of the moveable portion 201 towards their heel with their toes, thereby effecting movement of the platform 203 against the resistance provided by the resistance means, as shown in FIG. 3*b*. As the platform 203 of the moveable portion 201 is pulled towards the heel of the user, the platform 203 is drawn over the roller elements 205 of the moveable means 201. Rotation of the roller elements 205 effects smooth movement of the platform 203 from a relaxed position (as illustrated in FIG. 3*a*) to a tensed position (as illustrated in FIG. 3*b*).

As the platform 203 of the moveable portion 201 is forced rearwards by the strength of the user's foot, the cable (not shown) connecting the platform 203 to a resistance device via the pulley system 107 and attachment means 207, is drawn into the recessed portion 211 of the lower shell 113 of the base unit 103. The cable moves against the force of the resistance device and hence provides the resistance to the movement of the platform 203. As the cable is drawn over the lower pulley 123 and the upper pulley 121 of the pulley system 107, the upper and lower pulleys 121 and 123, rotate relative to axes 301 and 303, which are fixed to the stabilising structure 125 of the pulley system 107. In this way, smooth movement of the platform 203 of the moveable portion 201 against the resistance force is effected.

The user of the exercise device 101 has the option of retaining the platform 203 of the moveable portion 201 in a tensed position (as in FIG. 3*b*) for a certain period of time or alternatively, once the user has reached the fully tensed position, they can release a tension in the cable straightaway, returning the platform 203 to the relaxed position illustrated in FIG. 3*a*.

In order to increase the strength of the toes, the user repeats the above action a number of times. As the muscles of the foot and lower leg become stronger, the user can increase the resistance force acting on the platform 203, in order to progressively train the muscles of the foot and lower leg.

Exercise device 101 may further comprise shock absorbing springs or air pressure valves located within the recessed area 211 of the lower shell 113 of the base unit 103. The shock absorbing springs or air pressure valves provide cushioning of the platform 203 of the moveable portion 201 as it moves from a relaxed position to a tensed position and back to the relaxed position. This further enables smooth movement of the platform 203 of the moveable portion 201.

Figure 4:
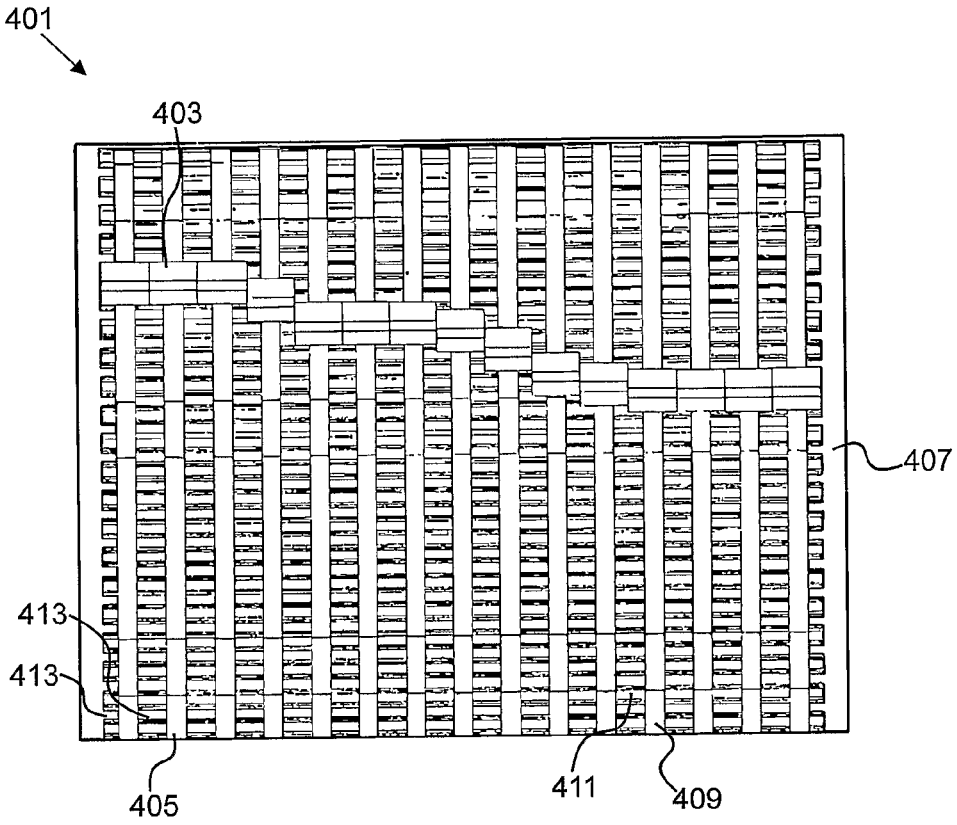
FIG. 4 shows a top view of a gripping surface suitable for use in the exercise device of the present invention.

With reference to FIG. 4 herein there is shown a gripping surface 401 which may be used in the exercise device of the present invention. Gripping surface 401 comprises fifteen protrusions 403 and fifteen corresponding tracks 405.

Protrusions 403 are substantially square shaped when viewed from above and extend upwardly from the uppermost surface 407 of the platform of the moveable portion on which the gripping surface 401 is disposed. Protrusions 403 move along the corresponding track 405 so as to be adjustable to fit the size of the toes and curvature of the toe joints of the user of the exercise device.

Corresponding tracks 405 comprises a central channel 409 and a plurality of engaging means having a plurality of teeth 411 and a plurality of voids 413. The plurality of teeth 411 are disposed equidistant from one another on either side of the central channel 409, with the plurality of voids 413 located between each pair of adjacent teeth 411. The plurality of teeth 411 on each side of the central channel 409 of the corresponding track 405 are aligned. Teeth 411 extend slightly from the uppermost surface 407 of the platform, to about a quarter of the height of the protrusions 403.

In use, the user of the exercise device upon which the gripping surface 401 is disposed moves the protrusions 403 along the corresponding tracks 405 in order to reposition the protrusion 403 to fit the shape of their toes. When the position of the protrusions 403 have been selected, they are secured in place by engagement with the plurality of teeth 411 and the plurality of voids 413 of the corresponding track 405.

The central channel 409 of the corresponding track 405 extends down through the uppermost surface 407 of the platform of the moveable portion.

With reference to FIG. 5*a* herein there is shown a protrusion 501 suitable for use with the gripping surface 401 of FIG. 4. Protrusion 501 comprises a body portion 503, two engager portions 505 and a rod member 507.

Body portion 503 of protrusion 501 has a three-dimensional rectangular shape having one angled edge 509 and one curved edge 511 positioned at the upper section of the body portion 503. The angled edge 509 of the upper section of the body portion 503 is located at the front edge of the protrusion 501. The curved edge 511 is located at the rear edge of the protrusion 501 and directs curling of the toe over the body portion 503 of the protrusion 501.

Engager portions 505 extend from the lower surface of the body portion 503 of the protrusion 501 on opposite sides thereof. Engager portions 505 are configured to secure the protrusion 501 in place on the corresponding track of the gripping surface by engagement with the teeth and voids located on either side of the corresponding track. The lower surfaces of engager portions 505 are curved in order to assist the movement of the protrusion 501 from one void over the adjacent teeth towards an alternative void.

Rod member 507 also extends from the lower surface of the body portion 503 of the protrusion 501 and is located between the engager portions 505. Rod member 507 comprises a resilient member 513 surrounding the rod member 507. Resilient member 513 has an upper flange 515 and a lower flange which are configured to restrict the movement of the resilient member 513, preventing it from moving up the rod member 507 and entering the space between the engager portions 505. Rod member 507 further comprises a hexagonal nut 519 which retains the resilient member 513 in place on the rod member 507.

Figure 5:
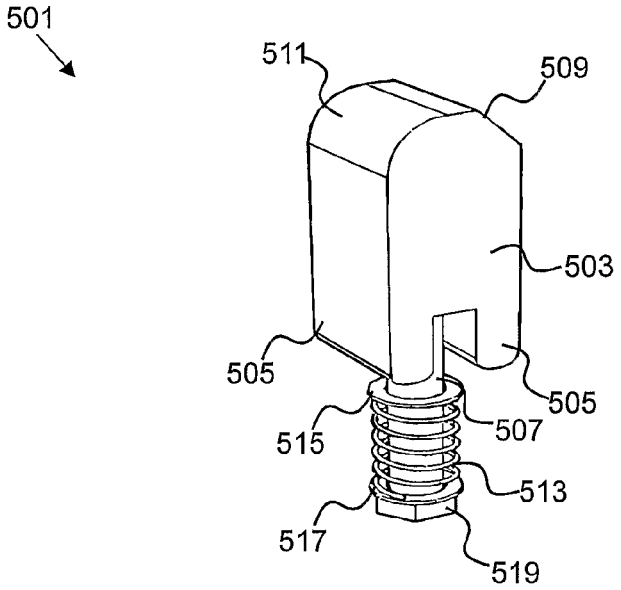
FIG. 5 shows a perspective side view of a protrusion suitable for use in the exercise device of the present invention.

With reference to FIGS. 6*a*, 6*b*, 6*c* and 6*d* herein, there is shown the protrusion 501 of FIG. 5 in use in an exercise device of the present invention.

FIGS. 6*a* to 6*d* show the protrusion 501 of FIG. 5 disposed on a gripping surface 601 comprising a corresponding track having a plurality of evenly spaced teeth 603 and a plurality of evenly spaced voids 605 disposed between adjacent teeth 603. Gripping surface 601 is disposed upon a platform 607 of a moveable portion, the platform comprising a recessed portion 609. The moveable portion further comprises a number of roller elements 611 upon which the platform 607 is disposed.

As in the previous embodiments, moveable portion is located in the recessed area of the base unit of the exercise device, such that platform 607 is located beneath a cut away section 615 in the upper shell 613 of the base unit in a relaxed position. Protrusion 501 extends upwardly from the cut-away section 615 in the upper shell 513 of the base unit.

When in position, protrusion 501 is situated on the corresponding tracks of the gripping surface 601 with its engager portions 505 located between adjacent teeth 603, in the voids 605 of the corresponding track. The rod portion 507 of the protrusion 501 extends from the lower section of the body portion of the protrusion 501 into the central channel (not shown) of the corresponding track, which extends through the upper surface of the platform 607 into the recessed portion 609 thereof. The resilient member 513 surrounding the rod member 507 is located within the recessed portion 609 of the platform 607 and the upper flange 515 of the resilient member 513 retains the resilient means 513 within the recessed portion 609 of the platform 607.

Resilient member 513 prevents the protrusion 501 from moving freely by securing the protrusion 501 on the corresponding track, preventing the engager portions 505 moving out of the voids 605 of the gripping surface 615 once in position.

Figure 6A:
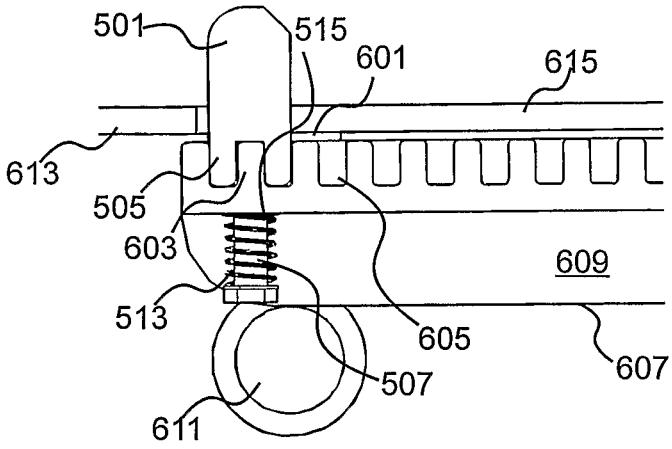
FIGS. 6*a* to 6*d* show a cross-sectional view of the moveable portion of the exercise device of the present invention in position under a recessed portion of the base unit, as the protrusion of the gripping surface is adjusted to fit the digit of the user.
Figure 6B:
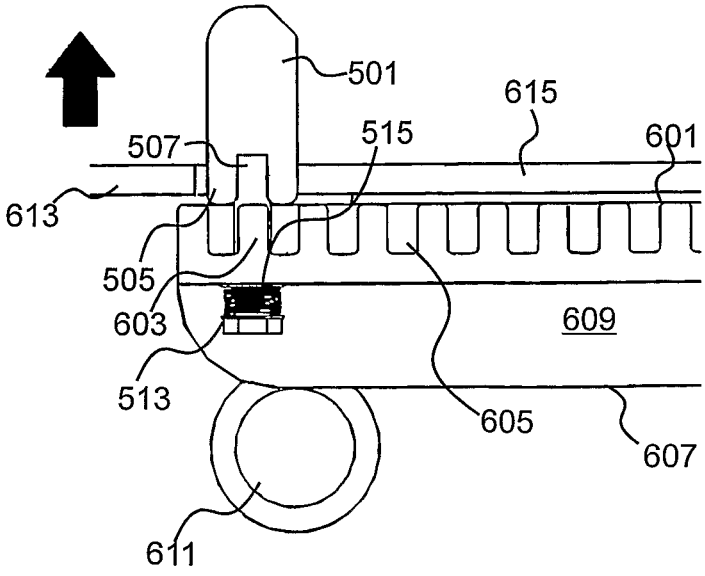
Figure 6C:
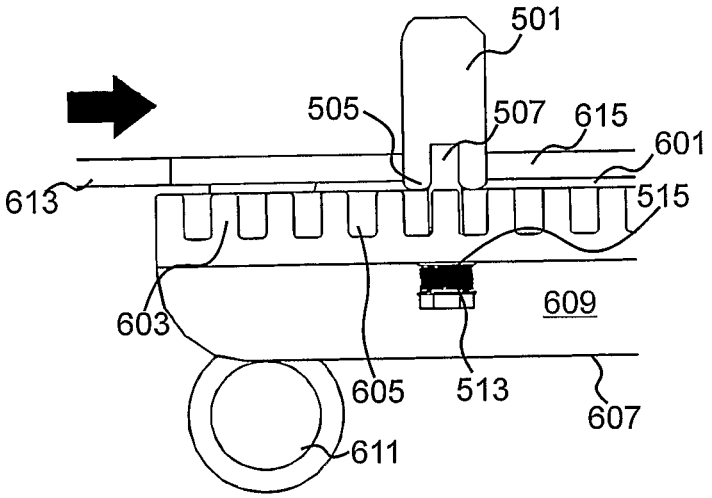
Figure 6D:
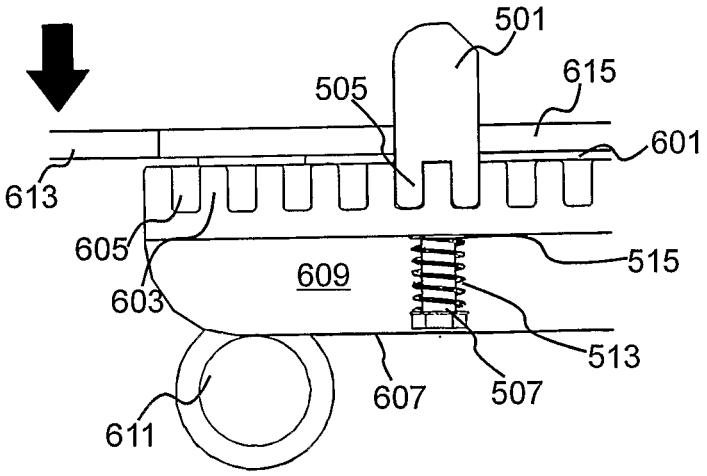

In order to adjust the position of the protrusion 501 to fit the shape of the toes of the user of the exercise device, the use pulls the protrusion 501 upwards, compressing the resilient member 513. This enables the engager portions 505 to move out of the voids 605 of the corresponding track of the gripping surface 601, as shown in FIG. 6*b*. The user then pulls the protrusion 501 along the corresponding track, keeping the resilient member 513 compressed, to a position in line with the shape of their toes as in FIG. 6*c*. Once the user has chosen the correct positioning of the protrusion 501 to match the shape of their toes, they release the protrusion 501, therefore relieving the tension in the resilient member 513 and allowing it to return to its relaxed state. Relaxation of the resilient member 513 draws the engager members 505 of the protrusion 501 into the voids 605 of the corresponding track, thereby securing the protrusion 501 in the required position.

Each protrusion is positioned in this way in order to adapt the gripping surface of the exercise device to fit the shape of the toes of the user. The exercise device will then ensure that all of the toes are exercised during use and so all of the intrinsic muscle groups of the foot and lower leg are progressively trained by the exercise device of the present invention.

Alternatively, the mechanism by which the protrusions 501 may be repositioned and secured about the gripping surface of the exercise device of the present invention may be by any suitable known means. For example, the resilient member may be located inside of the body portion of the protrusion and rather than having a rod member and engager portions extending from the lower section thereof, the body portion may be rounded at the lower section. Therefore, the protrusion will click and in and out of the voids of the corresponding track as the user of the device pulls them in an upward direction. The mechanism will also comprise a lever which raises the lower portion of the platform, thereby reducing the volume of the recessed portion of the platform and locking the protrusions into position.

Figure 7:
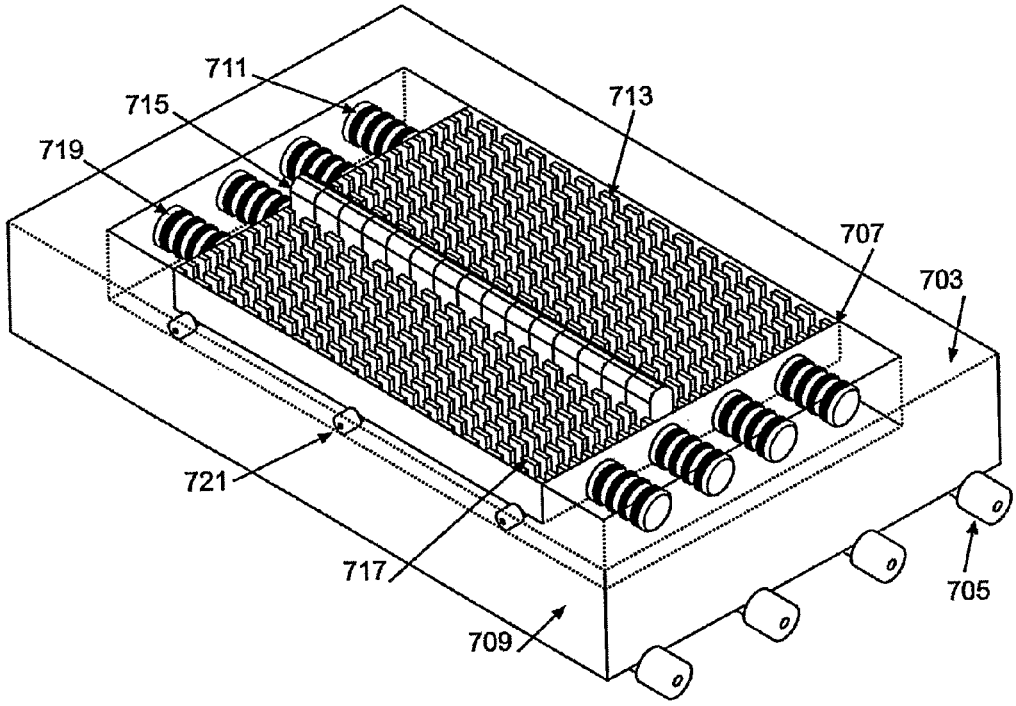
FIG. 7 shows a top perspective view of a moveable portion in accordance with a second embodiment of the present invention.
Figure 8:
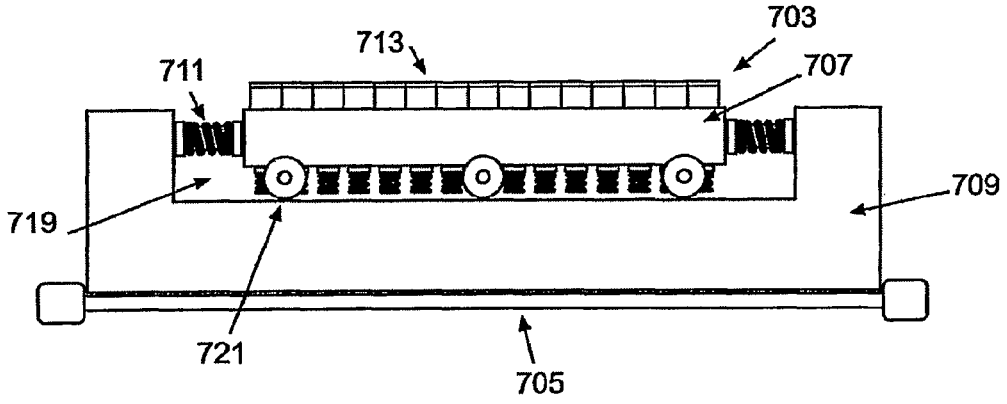
FIG. 8 shows a cross-sectional view of the moveable portion of FIG. 7.

With reference to FIGS. 7 and 8 herein there is shown an alternative embodiment of the moveable portion 701 of an exercise device of the present invention. Moveable portion 701 comprises a platform 703 and roller elements 705. Moveable portion 701 is located in the recessed area of the base unit of an exercise device of the present invention with the platform 703 located upon roller elements 705, as in FIG. 2. Roller elements 705 are fitted into channels of the base unit, as in FIG. 2, to allow them to rotate relative to the base unit, in the channels. In this way, platform 703 moves in the longitudinal direction within the recessed area of the base unit, over roller elements 705 as they rotate about their fixed position.

Platform 703 comprises an inner shell 707, an outer shell 709 and a plurality of resilient members 711.

Inner shell 707 comprises a gripping surface 713 disposed on the uppermost surface thereof. Gripping surface 713 comprises fifteen protrusions 715 and corresponding tracks 717 comprising a plurality of teeth and voids. Protrusions 715 extend from the uppermost surface of inner shell 707 and are capable of movement along the corresponding tracks 717, such that the user of the exercise device can position the protrusions 715, to fit the shape of their toes. Protrusions 715 may be secured in and moveable along the corresponding track 717 in the same way as described in FIGS. 6*a* to 6*d*.

Outer shell 709 is formed of a rectangular box shape having a central recessed portion 719. Inner shell 707 is disposed upon a series of smaller roller elements 721 within the recessed portion 719 of the outer shell 709. Inner portion 707 is also of a rectangular box shape and is of equal length to the recessed portion 719 of the outer shell 709 in the longitudinal direction. However, the recessed portion 719 of the outer shell 709 has a greater lateral length than the inner shell 707.

Inner shell 707 is located centrally within the recessed portion 719 of the outer shell 707. Eight resilient members 711 are located in the free space of the recessed portion 719 of the outer shell 709, evenly distributed on either side of the inner shell 707. Resilient members 711 may be in the form of a plurality of rubber springs which may be compressed when the inner shell 707 is moved from side to side.

In preparation for use, the user of the exercise device in which the moveable portion 701 is disposed adjusts the protrusions 715 of the gripping surface 713 to fit the shape of their toes, as described in relation to the previous embodiments. When the exercise device has been correctly adjusted to the requirements of the user, their foot has been positioned on the base unit by the heel support (not shown) and the type and strength of the resistance device selected, the user can commence using the exercise device.

In use, the user curls their toes around protrusion 715 of a gripping surface 713 and pull the platform 703 rearwards towards their heel, over roller elements 705. Once the platform 703 is in a tensed position, the user may force the inner shell 707 of the platform 703 from side to side against the resistance of the resilient members 711, in order to further train the intrinsic muscle groups of the foot and lower leg. In order to effect sidewards movement of the inner shell 707 of the platform 703, the user may push their toes sidewards against adjacent protrusions 715 on the gripping surface 713. As the inner shell 707 moves sideways within the recessed portion 719 of the outer shell 707, small roller elements 721 rotate about a fixed position to allow the inner shell 707 to move smoothly from side to side. If the smaller roller element 721 were removed from this arrangement, movement of the inner shell 707 would be uneven and would experience friction as it scrapes against the lower surface of the recessed portion 719.

In the alternative embodiment, the user of the exercise device in which the moveable portion 701 of FIG. 7 is employed can carry out the lateral movement of the inner shell 707 within the recessed portion 719 of the outer shell 709 of the platform 703 whilst the platform: 703 is in a relaxed position, i.e. when the platform 703 is stationary.

Resistance members 711 may be tightening in order to increase the resistance to the lateral movement of the inner shell 707 within the recessed portion 719 of the outer shell 719, in order to progressively train the muscles worked during this exercise.

In this embodiment, the outer shell 709 of the platform 703 cannot move in the lateral direction but only in the longitudinal direction against the force of resistance of the resistance means.

Figure 9:
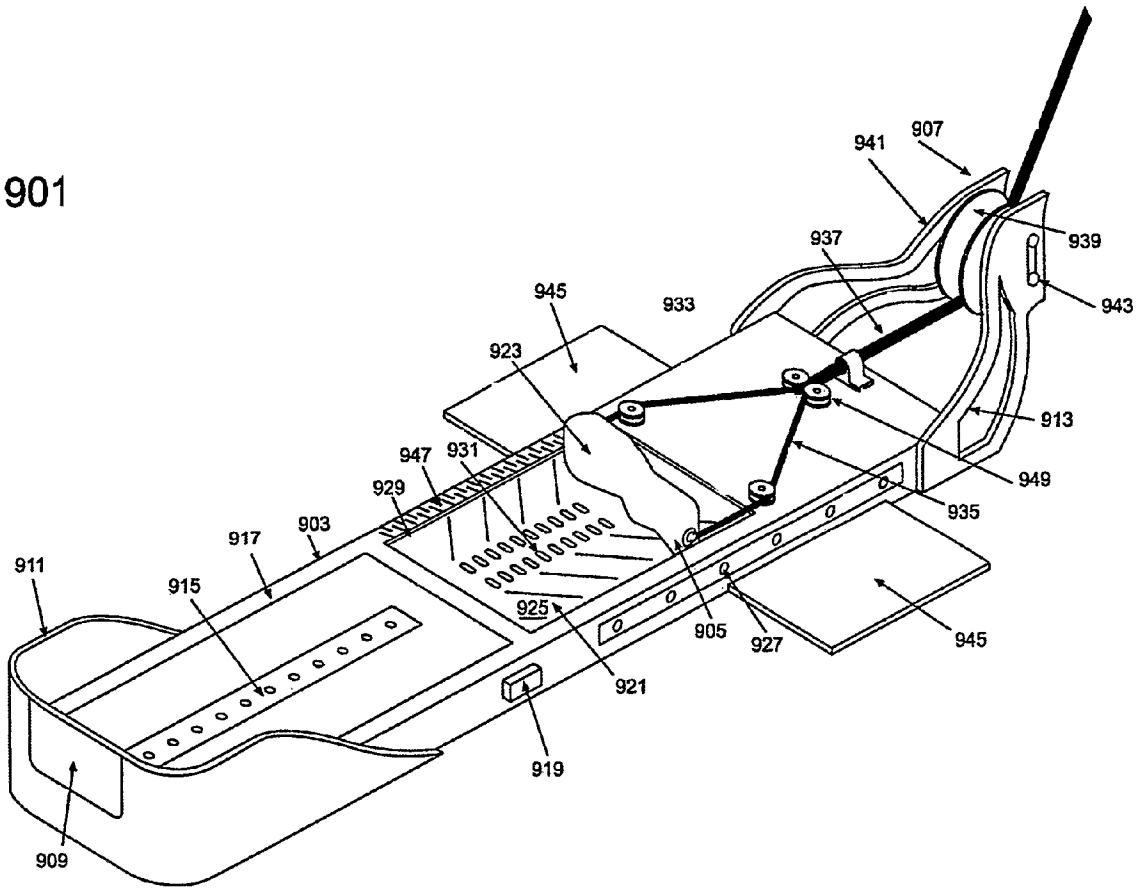
FIG. 9 shows the top perspective view of an exercise device in accordance with a second embodiment of the present invention.

With reference to FIG. 9 herein there is shown an alternative embodiment of the exercise device 901 of the present invention. Exercise device 901 comprises a base unit 903, a gripping surface 905, a pulley system 907 and a heel support 909.

Base unit 903 is substantially rectangular shaped having raised portions 911 and 913 located at each end thereof. Heel support 909 is located in the first raised portion 911 and is adjustable via a ratchet means 915 located on the upper surface 917 of the base Unit 903. Ratchet means 915 allows the heel support to be pushed forwards in order to be repositioned to meet the requirement of the user of the device 901. Heel support 909 is moveable only in a forward direction on ratchet means 915, therefore a lever 919 is provided which releases the heel support 909, allowing it to return to its original position at the raised portion 911.

In this embodiment, gripping surface 905 comprises a detachable bar 923 and is located on a moveable portion 921. Moveable portion 921 comprises a platform 925 and roller elements 927. Roller elements 927 are in the form of a plurality of ball bearings contained within a section of the internal portion of the base unit 903. Platform 925 is positioned below a cutaway section 929 in the upper surface 917 of the base unit 903.

Detachable bar 923 extends upwardly from the upper surface of the platform 925. Detachable bar 923 is shaped to fit the shape of the toes of the user and is fixed onto the upper surface of the platform 925 via pegs (not shown) which are located on the underside of the detachable bar 923. The pegs enable the detachable bar 923 to be clipped onto the upper surface of the platform 925 via receptive peg holes 931. Detachable bar 923 is detachably mounted on the upper surface of platform 925, such that if the bar positioned on the platform 925 does not correspond to the shape of the toes of the user, the user can remove the existing detachable bar 923 and replace it with a suitably shaped alternative detachable bar 923.

In this embodiment, detachable bar 923 is connected to pulley system 907 via cables 933, 935 and 937 and attachment ring 949. Pulley system 907 comprises a pulley 939 which is held in place by two stabilising arms 941 and 943 of the raised portion 913 of the base unit 903. Pulley 939 is rotable relative to stabilising arms 941 and 943 as the cable 937 passing over the pulley 939 is pulled backwards and forwards. Pulley system 907 is connected to a variable resistance device (not shown) via cable 937.

Base unit 903 is also provided with weight bearers 945 located near to the front portion of the base unit 903 which may be drawn from the internal portion of the base unit 903 when required. Weights (not shown) may be rested on weight bearers 945 of the exercise device 901 to prevent the exercise device 901 from lifting from the ground when the device 901 is used in conjunction with a large resistance force.

A gage 947 with markings is provided on the uppermost surface 917 of the base unit 903, adjacent to the gripping surface 905 and the platform 925 in a relaxed position. The gage 947 allows for the range of motion to be visually assessed when the gripping surface 905 and platform 925 are drawn rearwards in use.

In preparation for use, the user of the exercise device 901 selects the appropriate detachable bar 923 to fit the shape of their toes and clips it into place on the upper surface of the platform 925 of the moveable means 921. The user then adjusts the heel support 909 so that the heel support 909 supports their foot whilst their toes are curled over the detachable bar 923. This is done by pushing the heel support 909 forward along ratchet means 915 until it clicks into the correct position. The user then selects the type and strength of the resistance device and connects it to the exercise device 901 via cable 937.

Once the exercise device 901 has been correctly assembled for use, the user places the joints of their toes on the rear side of detachable bar 923 and curls their toes over the detachable bar 923. The user then pulls the detachable bar 923 with their toes against the resistance means, back towards the heel of their foot. As the detachable bar 923 is pulled backwards, it draws the platform 925 of the moveable portion 921 backwards, sliding over the roller elements 927 which rotate, thereby allowing smooth movement of the platform 925 and the detachable bar 923. The user may hold the weight in position for a period of time or slowly release the detachable bar 923, thereby releasing the tension in the cable 937 and returning the exercise device 901 to a relaxed position.

In order to train the muscles of the foot and lower leg, the user repeats this action a number of times. As the muscles in the foot and lower leg become stronger, the resistance force can be increased in order to progressively train and therefore strengthen the muscle groups in the foot and lower leg.

Figure 10A:
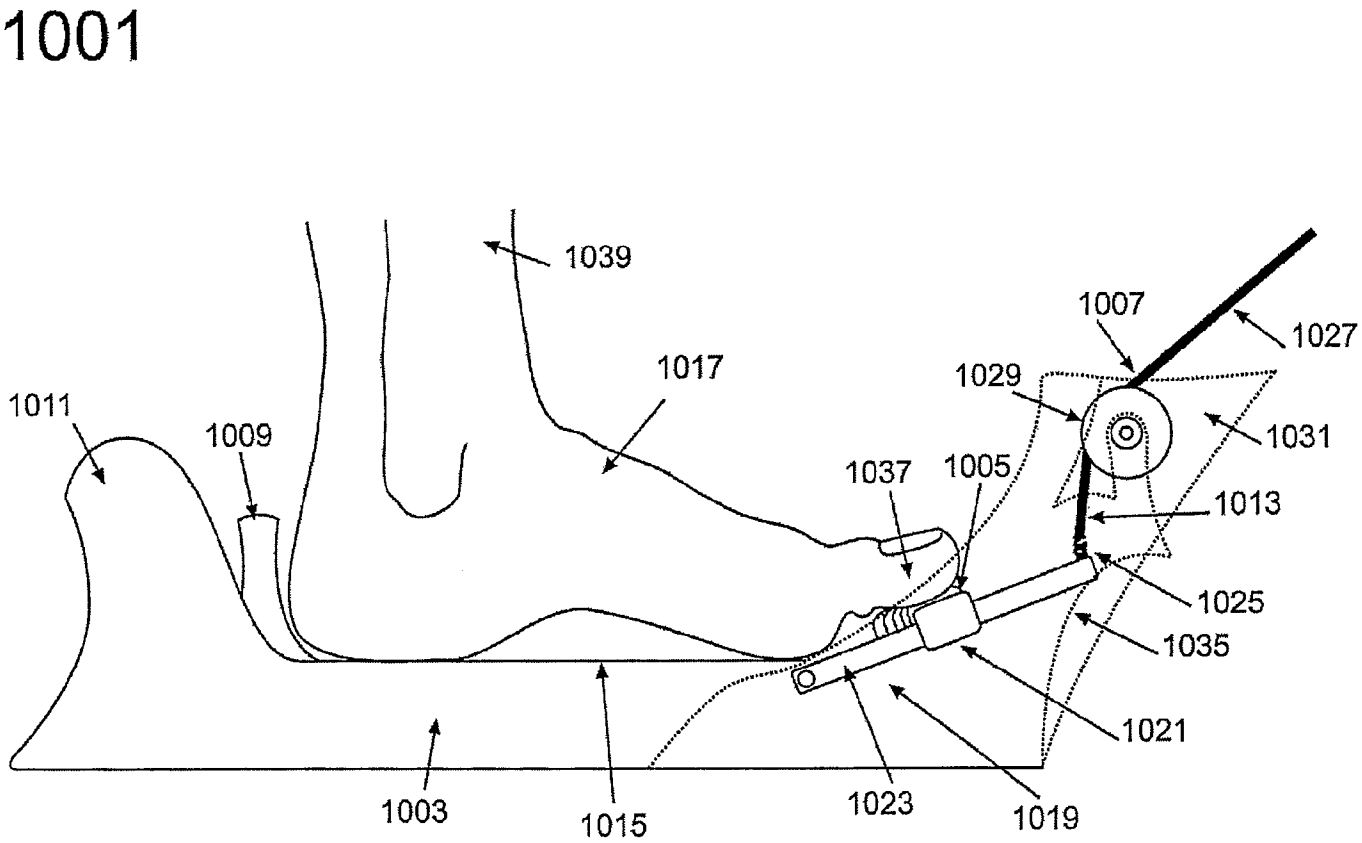
FIG. 10*a* shows a side view of the exercise device in accordance with a third embodiment of the present invention in a relaxed position.
Figure 10B:
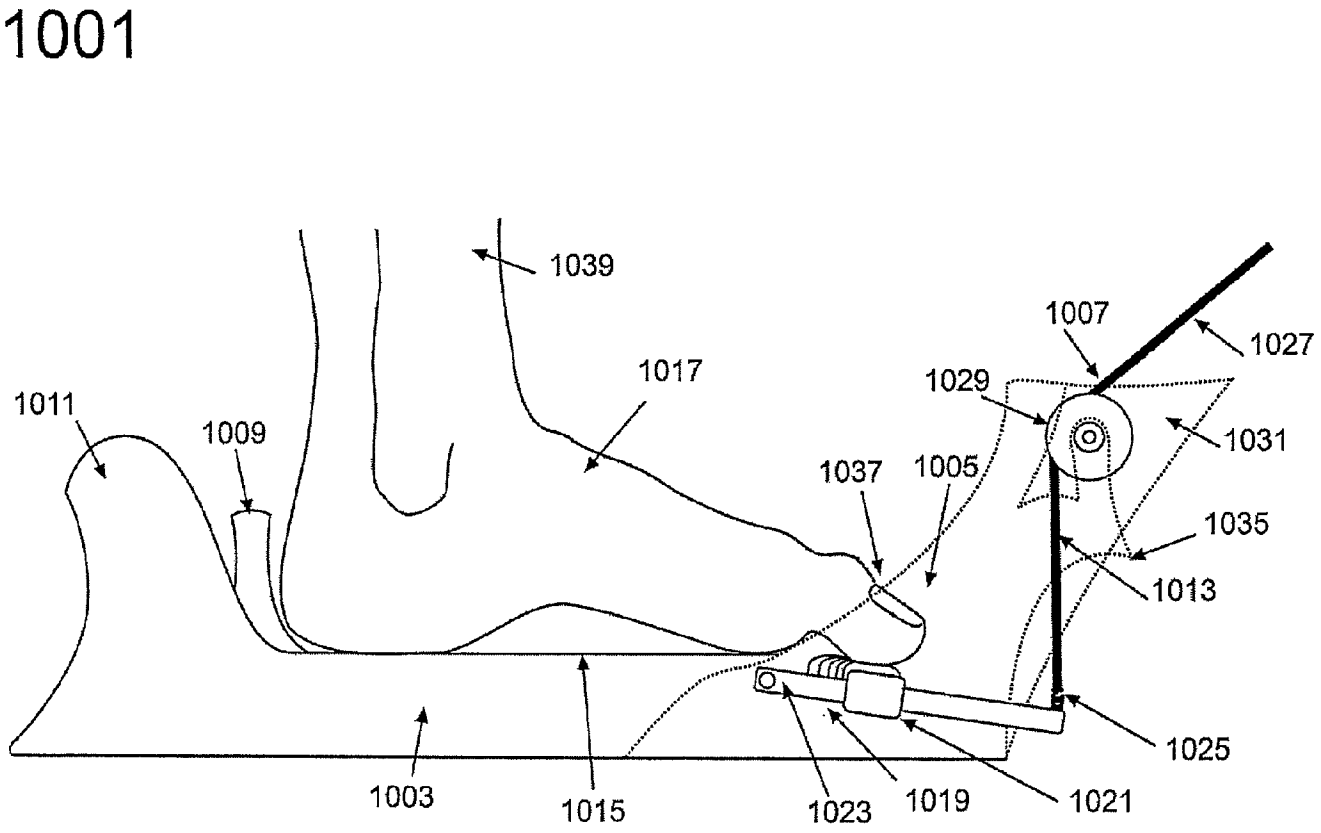
FIG. 10*b* shows a side view of the exercise device of FIG. 10*a* in a tensed position.

With reference to FIGS. 10*a* and 10*b* herein there is shown a third embodiment of the exercise device 1001 of the present invention. Exercise device 1001 comprises base unit 1003, gripping surface 1005, pulley system 1007 and heel support 1009.

Base unit 1003 comprises a first raised portion 1011 located at the rear end of the base unit 1003 and a second raised portion 1013 located at the front end of the base unit 1003. In these figures, a portion of the raised portion 1013 is illustrated by a dotted line to show the portion in cross section, in order for the features of the exercise device 1001 hidden by the portion of the raised portion 1013 to be visible.

Heel support 1009 extends from an upper surface 1015 of the base unit 1003 and is curved at the front side thereof. The curve of the heel support 1001 is configured to match the curve of the heel of the user's foot 1017. Heel support 1009 is adjustable on said base unit so that it can fit any size foot of the user. The means by which the heel support 1009 is adjustable may be similar to the corresponding feature in either FIG. 1 or FIG. 9.

Base unit 1003 further comprises a moveable portion 1019. Moveable portion 1019 comprises a platform 1021 and an inclined frame 1023 and extends from the front end of base unit 1003. Gripping surface 1005 is disposed upon the upper surface of platform 1021 of the moveable portion 1019. Inclined frame 1023 of moveable means 1019 is pivotably mounted at the front end of the base unit 1003 and platform 1021 is slidably mounted on the inclined frame 1023.

Inclined frame 1023 is connected via an attachment means 1025 to the pulley system 1007. Pulley system 1007 comprises a cable 1027 and a pulley 1029. Pulley 1029 is held in position by support members 1031 and 1033 of the raised portion 1013 of the base unit 1003 and is rotatable relative to the supporting members 1031 and 1035. Pulley system 1007 is connected to a resistance device via cable 1027.

In preparation for use, the user of the exercise device 1001 positions the heel support 1009 to fit the foot size 1017 of the user so that the toes 1037 of the user rest on the previously adapted gripping surface 1005 disposed on the platform 1021 of the moveable portion 1019. Cable 1027 of the pulley system 1007 is attached to the selected type and strength of resistance device.

Once assembled, the user uses the strength in their toes to push the inclined frame 1023 of the moveable portion 1013 downwards. As the inclined frame 1023 is pushed downwards, the user grips the gripping surface 1005 by curling their toes 1037, hence moves the platform 1021 along the inclined frame 1023 towards the heel of their foot 1017, as shown in FIG. 10*b*. Downward movement of the inclined frame 1023 of the moveable means 1019 acts against the resistance force as the cable 1027 attached to the resistance device is drawn downwards over pulley 1029. The user then slowly returns the inclined frame 1023 to its original position as illustrated in FIG. 10*a*. These actions will be repeated a number of times to train the muscles of the foot and lower leg.

As in the previous embodiment, the resistance force apparatus can be increased in order to progressively train the muscle groups of the foot 1017 and leg 1039 of the user by use of the exercise device of the present invention 1001.

Figure 11:
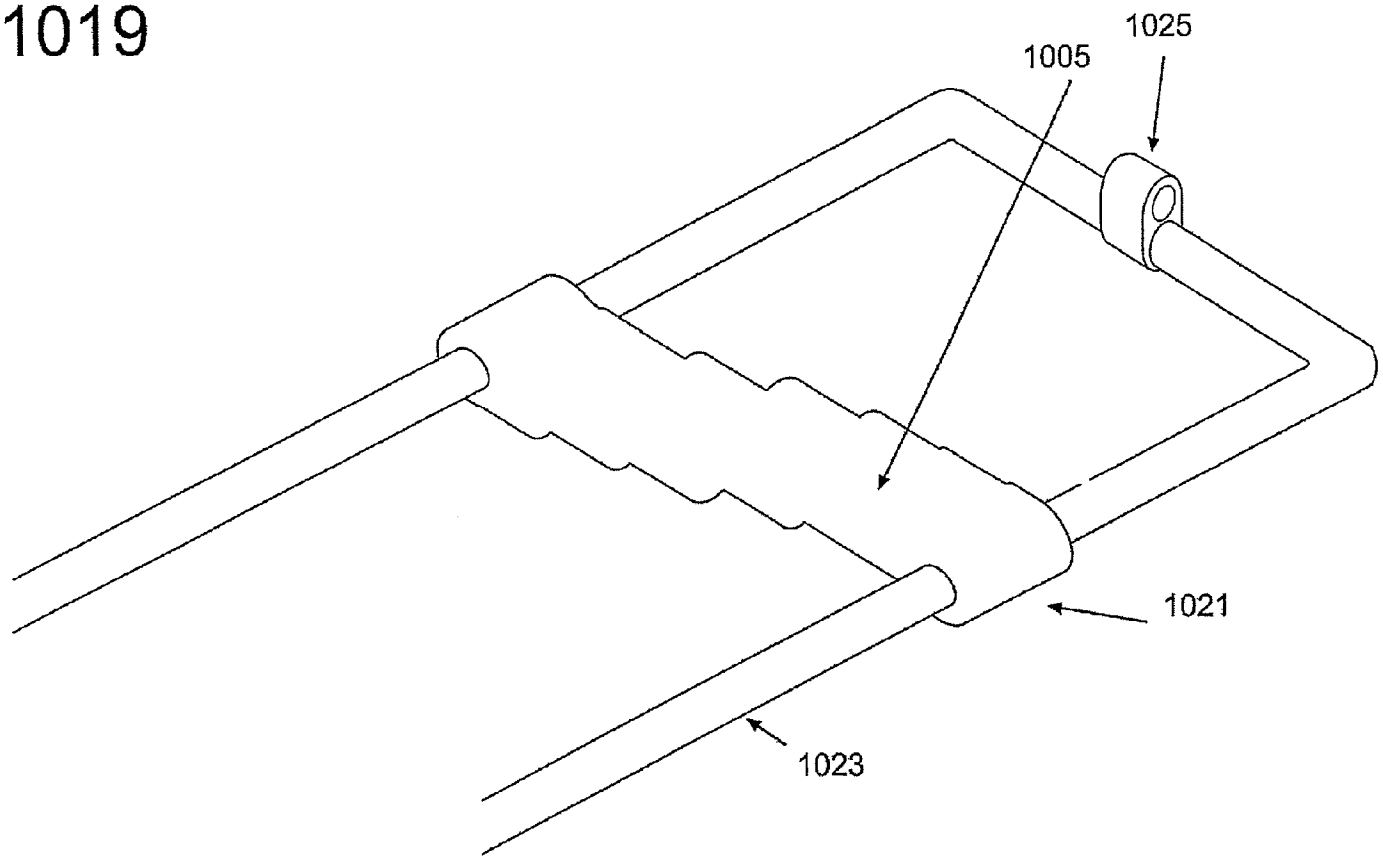
FIG. 11 shows a top perspective view of the moveable portion of the exercise device of FIG. 10*a*.

With reference to FIG. 11 herein there is shown the moveable portion 1019 of the exercise device 1001 of FIGS. 10*a* and 10*b*. Moveable portion 1019 comprises platform 1021 and inclined platform 1023.

Platform 1021 is slidably mounted on inclined frame 1023 and comprises gripping surface 1005 at the upper surface thereof. Gripping surface 1005 comprises a plurality of recessed portions 1101 configured to receive the toes of the user of the exercise device such that the toes may curl into the recessed portion 1101 and grip the platform 1021. Gripping of the platform 1021 enables it to slide back and forth on the inclined frame 1023.

Platform 1021 is removable mounted on the inclined frame 1023 such that the user can select a platform having the correct distribution, size and depth of the recessed portions 1101 of the gripping surface 1005 to fit the shape of their toes. In this embodiment, platform 1021 is capable of clipping onto the inclined frame 1023 of the moveable means 1019 such that if the user applies force to the platform 1021, it can be unclipped.

Alternatively, gripping surface 1005 may comprise plurality of protrusions as in FIG. 4, which are moveable on corresponding tracks to fit the shape of the foot of the user of the device.

Inclined frame 1023 is cylindrical and forms a rectangular shape. Located at the uppermost and front side of the inclined frame 1023 is an attachment means 1025. Attachment means 1025 is attached to a resistance device via a cable of a pulley system such that movement of the inclined frame 1023 of the moveable portion 1019 acts against the resistance force of the resistance device therefore training the muscles of the foot and lower leg.

In an alternative embodiment of the present invention, the gripping surface, disposed on the platform of the moveable portion, may comprise a plurality of looped cords that may be adjusted to fitted the shape, size and length of the digits of the user. In this embodiment, the looped cords are attached via the pulley system to the resistance device. In use, the user grips the looped cords with their digits and pulls the cords rearwards against the force of the resistance device. As the digits pull the cords rearwards, the platform on which the digits are located slides over the roller elements of the moveable portion to prevent a build up of friction.

Although the above embodiments have been described in relation to apparatus suitable for training the intrinsic muscle groups of the foot and lower leg, it should be understood that the apparatus may be re-designed in order to be used to progressively train the intrinsic muscle groups of the hand and lower arm.

The invention claimed is:

1. An exercise device suitable for progressively strengthening the intrinsic muscle groups of a limb extremity and the associated limb of a user, said device comprising:

a base unit;

a gripping surface configured to be gripped by a plurality of digits of said limb extremity of said user; and a resistance means for providing a resistance force;

wherein said gripping surface comprises a plurality of moveable members and a plurality of corresponding tracks;

wherein each said moveable member is moveable along a respective one of the tracks and can be fixed to the gripping surface in a selected one of a plurality of positions along the respective corresponding track, so that the distribution of said movable members on said gripping surface is adapted to fit to the size and distribution of said plurality of digits of said limb extremity of said user;

wherein said exercise device further comprises a moveable portion configured to act against said resistance means, said moveable portion being located within a recess of said base unit; and said moveable portion being configured to move longitudinally within said recess;

wherein said moveable portion comprises a platform and at least one roller element, said platform having an upper surface;

said at least one roller element being located within said recess of said base unit;

said platform being disposed upon said at least one roller element; and wherein said gripping surface is disposed upon the upper surface of said platform.

2. The exercise device according to claim 1 wherein said resistance means is capable of varying the resistance force provided to said exercise device.

3. The exercise device according to claim 1 wherein said moveable members are in the form of protrusions extending from said gripping surface; and movement of each said protrusion is independent of the movement of each adjacent protrusion.

4. The exercise device according to claim 1 wherein said platform is connected to said resistance means.

5. The exercise device according to claim 1 wherein said exercise device further comprises an adjustable heel support means.

6. The exercise device according to claim 1 wherein said resistance means comprises a pulley system configured to be attached to an external weight stack.

7. The exercise device according to claim 1 wherein said resistance means comprises a pulley system configured to be attached to an internal elastic resistance means, said internal elastic resistance means being disposed within said base unit.

8. The exercise device according to claim 1 wherein said platform of said moveable portion comprises an inner shell and an outer shell;

said outer shell comprising a recessed portion in which said inner shell is disposed; and said inner shell being capable of lateral movement within said recessed portion of said outer shell.

9. The exercise device according to claim 8 wherein said platform further comprises a resilient means configured to oppose the lateral movement of said inner shell within said recessed portion of said outer shell.

10. The exercise device according to claim 1 wherein said moveable portion comprises a spotting means configured to allow the user of said exercise device to assist the movement of said moveable portion against said resistance means.

11. An exercise device suitable for progressively strengthening the intrinsic muscle groups of a limb extremity and the associated limb of a user, said device comprising:

a base unit;

a gripping surface configured to be gripped by a plurality of digits of said limb extremity of said user; and a resistance means for providing a resistance force;

wherein said gripping surface comprises a plurality of moveable members and a plurality of corresponding tracks;

wherein each said moveable member is moveable along a respective one of the tracks and can be fixed to the gripping surface in a selected one of a plurality of positions along the respective corresponding track, so that the distribution of said movable members on said gripping surface is adapted to fit to the size and distribution of said plurality of digits of said limb extremity of said user;

wherein said exercise device further comprises a moveable portion configured to act against said resistance means, said moveable portion being located within a recess of said base unit; and said moveable portion being configured to move longitudinally within said recess;

wherein said moveable portion comprises a platform and at least one roller element;

said at least one roller element being located within said recess of said base unit; and said platform being disposed upon said at least one roller element;

wherein said platform of said moveable portion comprises an inner shell and an outer shell;

said outer shell comprising a recessed portion in which said inner shell is disposed;

said inner shell being capable of lateral movement within said recessed portion of said outer shell; and wherein said platform further comprises a resilient means configured to oppose the lateral movement of said inner shell within said recessed portion of said outer shell.

* * * * *